US008297185B2

(12) United States Patent
Noguchi

(10) Patent No.: US 8,297,185 B2
(45) Date of Patent: Oct. 30, 2012

(54) DUPLEX PRINTING APPARATUS WITH A STORAGE SECTION FOR STORING A PLURALITY OF SHEETS

(75) Inventor: Yoshihiro Noguchi, Ibaraki-ken (JP)

(73) Assignee: Riso Kagaku Corporation (JP)

( * ) Notice: Subject to any disclaimer, the term of this patent is extended or adjusted under 35 U.S.C. 154(b) by 649 days.

(21) Appl. No.: 12/481,936

(22) Filed: Jun. 10, 2009

(65) Prior Publication Data

US 2009/0311018 A1 Dec. 17, 2009

(30) Foreign Application Priority Data

Jun. 11, 2008 (JP) ..... 2008-152691

(51) Int. Cl.

| | |
|---|---|
| ***B41F 5/02*** | (2006.01) |
| ***B41F 3/40*** | (2006.01) |
| ***B41F 1/20*** | (2006.01) |
| ***B41L 13/04*** | (2006.01) |

(52) U.S. Cl. ..... 101/229; 101/116; 101/262; 101/296

(58) Field of Classification Search ..... 101/116, 101/118, 416.1, 229, 262, 296, 190; 399/402
See application file for complete search history.

(56) References Cited

U.S. PATENT DOCUMENTS 7,549,723 B2 * 6/2009 Mihara et al. ..... 347/23

FOREIGN PATENT DOCUMENTS

JP 2005029375 A 2/2005

OTHER PUBLICATIONS

Translation of JP 2005-029375 to Matsushita et al. published on Jul. 11, 2003.*

* cited by examiner

*Primary Examiner* — Judy Nguyen
*Assistant Examiner* — Blake A Tankersley
(74) *Attorney, Agent, or Firm* — Studebaker & Brackett PC; Donald R. Studebaker

(57) ABSTRACT

A duplex printing apparatus is equipped with: a first printing section for printing on first sides of sheets; a storage section for storing a plurality of the sheets, the first sides of which have been printed on; a second printing section for printing on second sides of the sheets; a first conveying section for sequentially conveying the sheets, the first sides of which have been printed on, to the storage section; and a second conveying second for sequentially conveying the plurality of sheets which are stored at the storage section to the second printing section. The storage section is equipped with a holding mechanism that holds the plurality of sheets, the first sides of which have been printed on, in an overlapped state with predetermined intervals therebetween.

22 Claims, 11 Drawing Sheets

SHEET LOADING DIRECTION
D
P2
SHEET EJECTING DIRECTION
E
141c
141d (C1)
141c
141d(C2)
141c
141c
F
141
141a
141d
141c
141a

SHEET LOADING DIRECTION
D
P2
SHEET EJECTING DIRECTION
F
241d (C1)
241d(C2)
241
241a
F
241d

DUPLEX PRINTING APPARATUS WITH A STORAGE SECTION FOR STORING A PLURALITY OF SHEETS

BACKGROUND OF THE INVENTION

1. Field of the Invention

The present invention is related to a duplex printing apparatus for printing on both the front surfaces and the rear surfaces of sheets. In particular, the present invention is related to a duplex printing apparatus which is capable of securing time for ink which has been printed on the front surface to dry.

2. Description of the Related Art

Recently, there is desire to reduce the amount of paper sheets which are utilized, from the viewpoint of environmental problems. For this reason, duplex printing, in which printing is performed on both the front surfaces and the rear surfaces of sheets, is commonly being performed. Duplex screen printing apparatuses that perform screen printing on both surfaces of sheets have been proposed. An example of such a duplex screen printing apparatus is equipped with a first cylindrical drum and a second cylindrical drum. Screen printing stencils are wound about the outer peripheral surfaces of the first and second drums. The first drum performs printing onto the front surfaces of sheets, the sheets, of which the front surfaces have been printed on, are conveyed to the second drum, and the second drum performs printing onto the rear surfaces of the sheets.

In the duplex printing apparatus as described above, printing is performed onto the rear surfaces of sheet, the front surfaces of which have already been printed on. Therefore, there is a possibility that the sheets will become stained due to the ink on the front surfaces not being sufficiently dry during conveyance to the second drum and during printing onto the rear surfaces thereof.

Therefore, a duplex printing apparatus that performs printing such that sheets, of which the front surfaces have been printed on, are temporarily held for a predetermined amount of time on a stage to dry the ink on the stage, has been proposed in Japanese Unexamined Patent Publication No. 2005-029375.

However, the duplex printing apparatus disclosed in Japanese Unexamined Patent Publication No. 2005-029375 stacks sheets, of which the ink on the surfaces thereof are not dry, on the stage. Therefore, there is a possibility that rubbing of the printed surfaces and seepage of ink will cause the sheets to be stained. In addition, sheets, onto which large amounts of ink have been transferred, have high liquid content therein. Therefore, the close contact properties among the surfaces of the sheets will increase, and multiple sheets may be conveyed when attempting to convey the sheets one by one. In addition, the sheets may become corrugated due to absorption of liquid, which will result in unsuccessful conveyance.

SUMMARY OF THE INVENTION

The present invention has been developed in view of the foregoing circumstances. It is an object of the present invention to provide a duplex printing apparatus that enables fast drying of ink and fast printing, that prevents rubbing of printed surfaces and seepage of ink, even in cases that large amounts of ink are transferred onto sheets.

A duplex printing apparatus according to the present invention comprises:

first printing means for printing on first sides of sheets;

a storage section for storing a plurality of the sheets, the first sides of which have been printed on;

second printing means for printing on second sides of the sheets;

first conveying means for sequentially conveying the sheets, the first sides of which have been printed on, to the storage section; and second conveying means for sequentially conveying the plurality of sheets which are stored at the storage section to the second printing means; characterized by:

the storage section being equipped with a holding mechanism that holds the plurality of sheets, the first sides of which have been printed on, in an overlapped state with predetermined intervals therebetween.

In the duplex printing apparatus of the present invention, it is preferable for the storage section to have a sheet insert position, at which the sheets which are conveyed by the first conveying means enter the storage section, and a sheet discharge position, at which the stored sheets are passed on to the second conveying means; for the sheet insert position and the sheet discharge position to be spaced a predetermined distance apart from each other; and for the holding mechanism to sequentially hold each of the sheets that enter the storage section from the sheet insert position, and to move each of the sheets toward the sheet discharge position, while the sheets are in an overlapped state with predetermined intervals therebetween.

In the duplex printing apparatus of the present invention, it is also preferable for the holding mechanism to support the bottom edges of each of the plurality of sheets with predetermined intervals therebetween such that they are held in an upright state, and such that the sheets are curled with the first sides thereof toward the interiors of concave shapes which are formed in horizontal cross sections.

In this case, it is preferable for the holding mechanism to be equipped with a bottom edge supporting means, for supporting the bottom edges of each of the plurality of sheets with predetermined intervals therebetween such that they are held in an upright state, and curl imparting means, for imparting curls to the sheets such that they are curled with the first sides thereof toward the interiors of concave shapes which are formed in horizontal cross sections.

In addition, it is also preferable in this case for the storage section to have a sheet insert position, at which the sheets which are conveyed by the first conveying means enter the storage section, and a sheet discharge position, at which the stored sheets are passed on to the second conveying means; for the sheet insert position and the sheet discharge position to be spaced a predetermined distance apart from each other; and for the bottom edge supporting means to sequentially support the bottom edge of each of the sheets that enter the storage section from the sheet insert position, and to move each of the sheets toward the sheet discharge position, while the sheets are in an overlapped state with predetermined intervals therebetween.

In the duplex printing apparatus of the present invention, it is preferable for the bottom edge supporting means to support the bottom edges of the sheets and to move the sheets in the direction that the first sides face toward.

In the duplex printing apparatus of the present invention, the bottom edge supporting means may be equipped with recesses which are arranged with predetermined intervals therebetween in the direction that the sheets are moved in; the bottom edges of the sheets tray be supported by the recesses; and the sheets may be moved by moving the recesses in the direction that the sheets are moved in.

Alternatively, the bottom edge supporting means may be a threaded shaft that extends in the direction that the sheets are moved in; the threads of the threaded shaft may support the bottom edges of the sheets; and the sheets may be moved by rotating the threaded shaft.

As a further alternative, the bottom edge supporting means may be equipped with clamps which are capable of being opened and closed, arranged with predetermined intervals therebetween in the direction that the sheets are moved in; the clamps may grip the bottom edges of the sheets; and the sheets may be moved by moving the clamps in the direction that the sheets are moved in.

In the duplex printing apparatus of the present invention, it is preferable for the curl imparting means to be a guide member that presses the left and right side portions of the sheets which are conveyed into the sheet insert position toward the direction that the first sides face than the central portions of the sheets, such that the sheets are curled with the first sides thereof toward the interiors of concave shapes which are formed in horizontal cross sections.

It is preferable for the duplex printing apparatus of the present invention to further comprise: control means, for controlling the amount of time that the sheets are stored for between the time that the sheets are conveyed into the storage section, based on the print rate onto the first sides of the sheets.

Note that in the present specification, the term "print rate" refers to the percentage of a printed area with respect to the entire area of a surface of a sheet. For example, the print rate is the percentage of black image data with respect to the entirety of black and white binary image data that represent an image to be printed by the first printing means (the black image data is where apertures are formed in a screen printing stencil, and the white image data is where no apertures are formed in the screen printing stencil) in the case of screen printing.

In the case that the control means is provided, it is preferable for the control means to control the speed of movement of the sheets from the sheet insert position to the sheet discharge position.

In the duplex printing apparatus of the present invention, at least one of the first conveying means and the second conveying means may be equipped with a suctioning section for conveying the sheets into and out of the storage section while suctioning the sheets; and the duplex printing apparatus may further comprise a separating means, for separating the sheets which are suctioned onto the at least one suctioning section.

In this case, it is preferable for the bottom edge supporting means to move the sheets in an intermittent manner and for the duplex printing apparatus to further comprise a separating operation control means, for causing the separating means to perform separating operations at timings which are synchronized with the intermittent movement of the sheets by the bottom edge supporting means.

In the duplex printing apparatus of the present invention, it is preferable for the guide member to be configured such that the position thereof along the direction that the sheets are moved in is adjustable.

Note that the "first printing means" may be a printing means that performs printing by any method, as long as printing is performed by adding ink to sheets. Examples of such printing means include screen printing means and ink jet printing means. In addition, the "second printing means" of the present invention is similarly not limited to any particular type of printing means.

In addition, the "upright state" that the sheets are held in by the holding mechanism of the present invention refers to a state in which the sheets are upright with respect to gravity. It is not necessary for the sheets to be perfectly vertically oriented, and the term "upright state" also refers to states in which the sheets are held obliquely with respect to the vertical direction. In the case that the sheets are held obliquely with respect to the vertical direction, it is preferable for the angle formed by the sheets with respect to the vertical direction to be within a range from 5° to 45°, and more preferable within a range from 10° to 30°.

According to the duplex printing apparatus of the present invention, the storage section is equipped with a holding mechanism that holds the plurality of sheets, the first sides of which have been printed on, in an overlapped state with predetermined intervals therebetween. Therefore, the sheets can be held without the printed surfaces, that is, the surfaces onto which ink has been transferred, coming into contact with each other. In addition, the ink can be dried by storing the sheets. Accordingly, rubbing of printed surfaces and seepage of ink can be prevented, and fast drying of ink and fast printing are enabled.

BEST MODE FOR CARRYING OUT THE INVENTION

Figure 1:
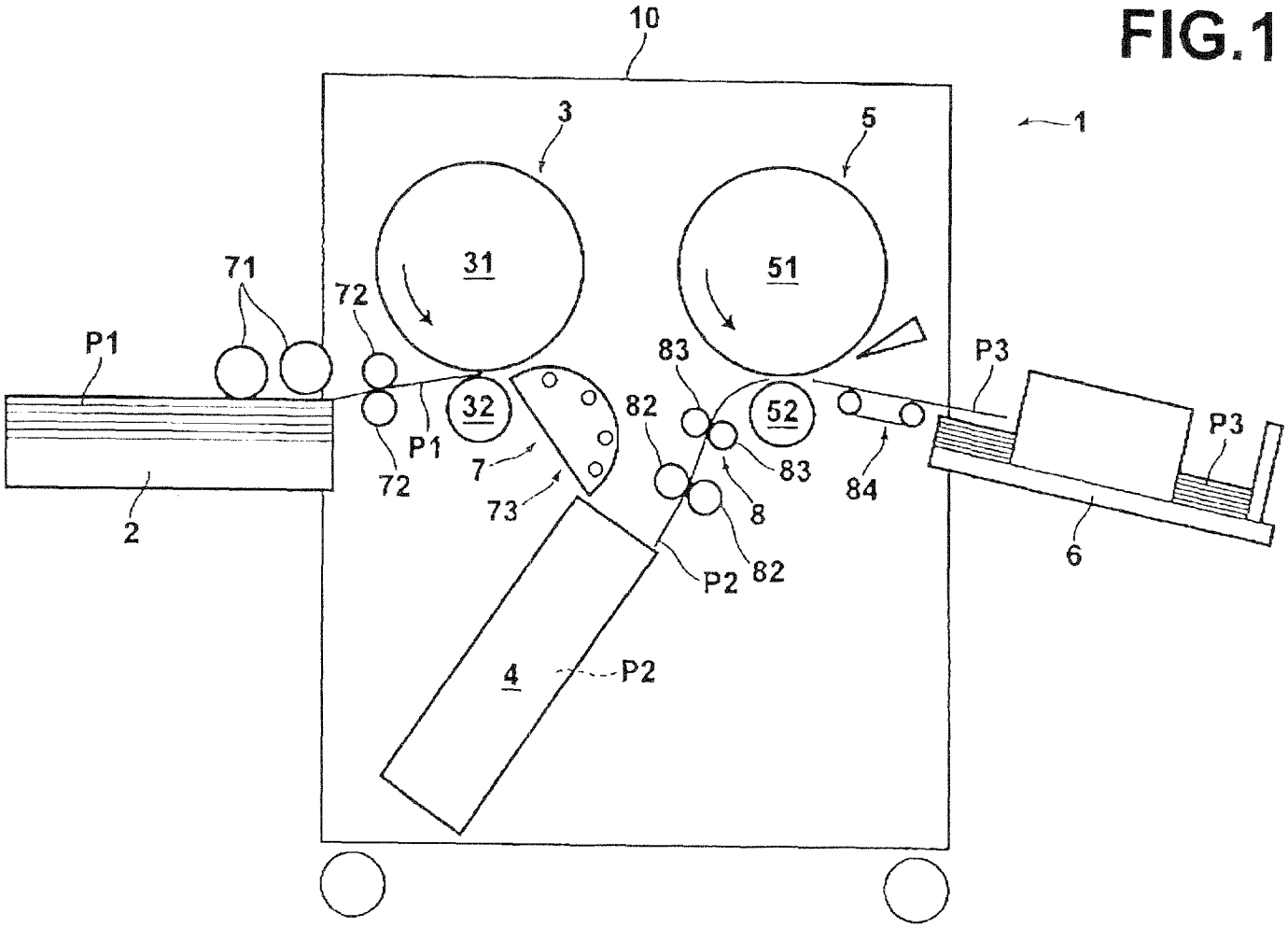
FIG. 1 is a diagram that illustrates the schematic construction of a duplex screen printing apparatus.
Figure 2:
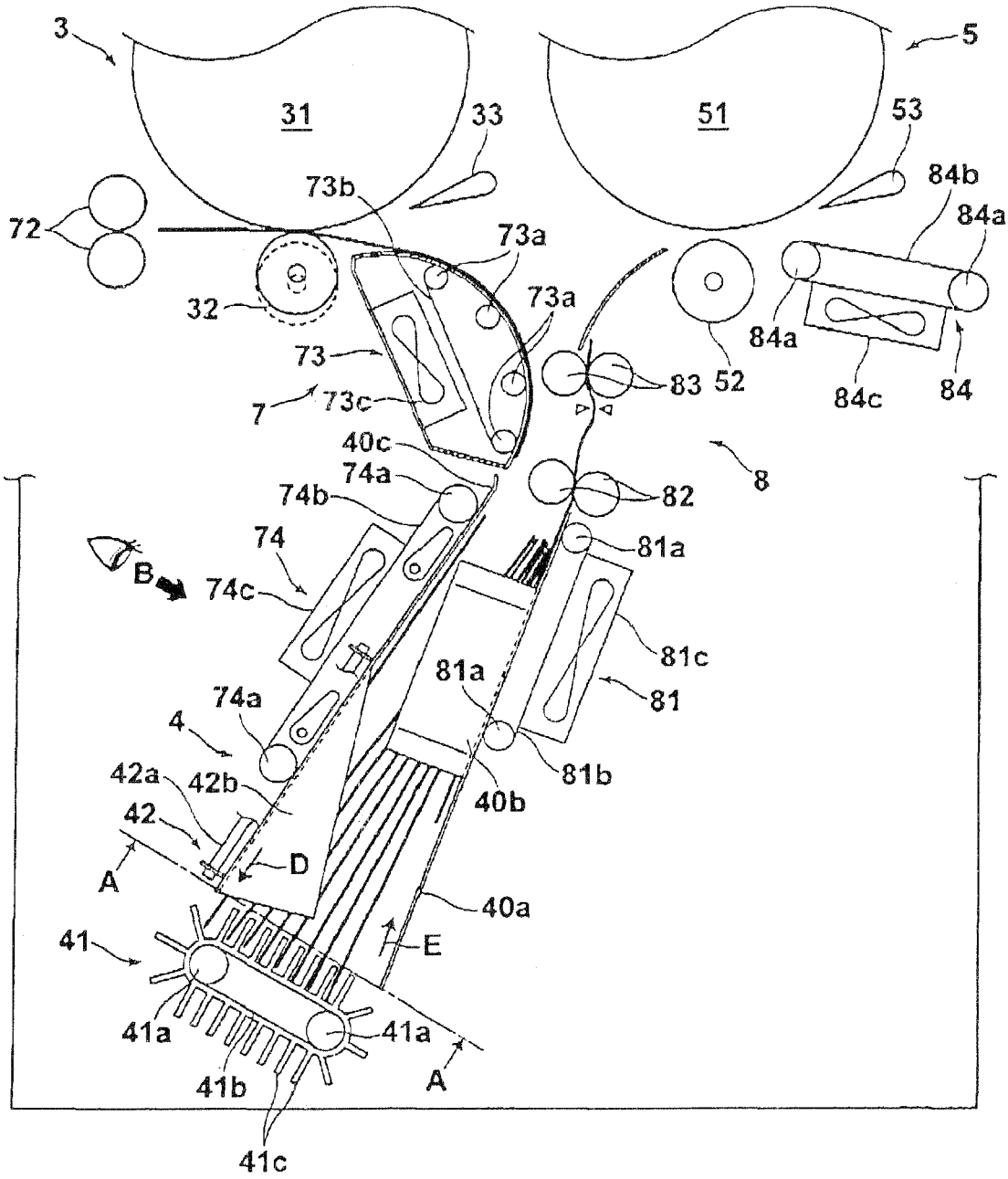
FIG. 2 is a diagram of the details of the main parts of the duplex screen printing apparatus of FIG. 1.
Figure 3:
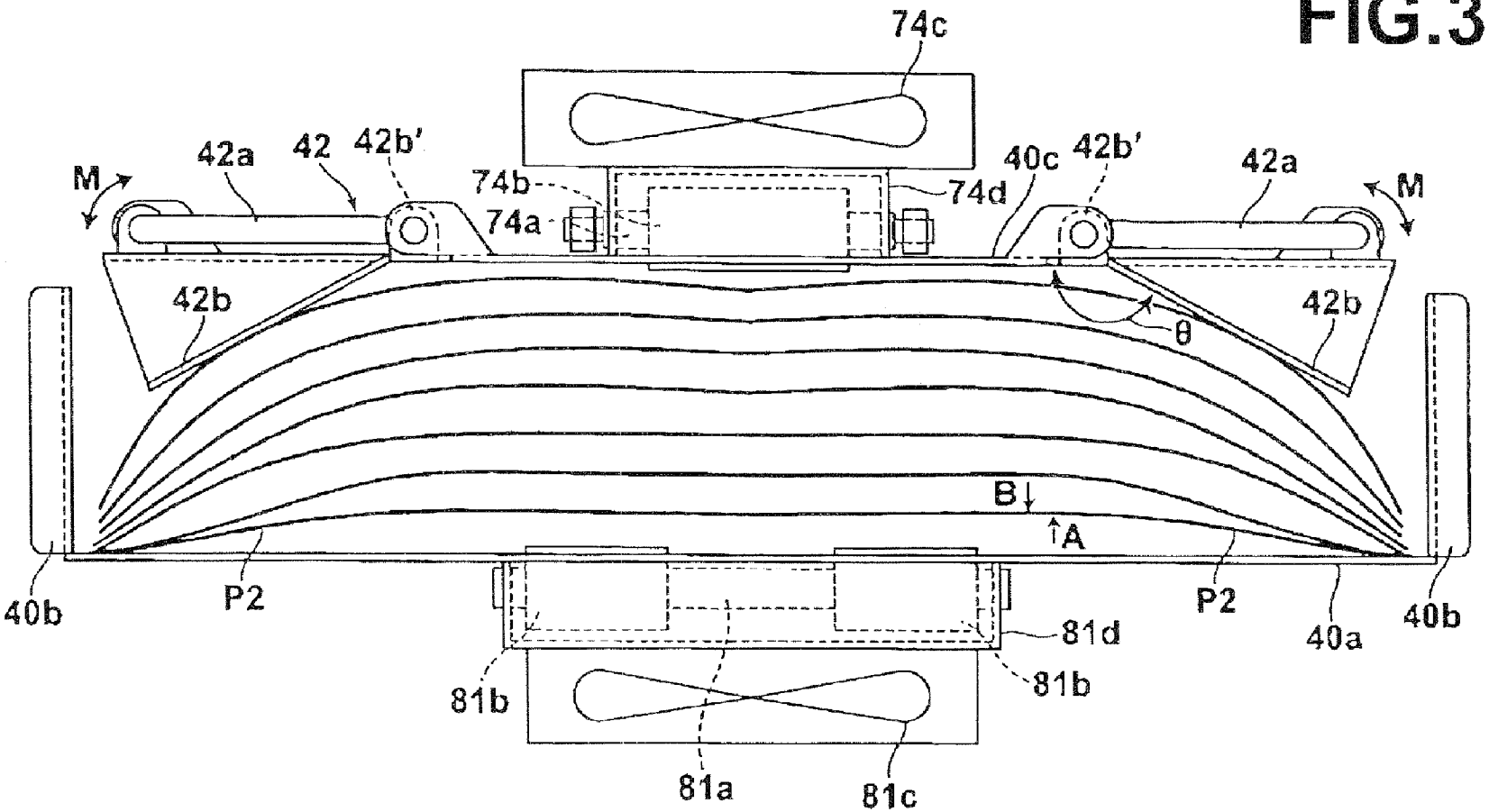
FIG. 3 is a sectional view taken along line A-A of FIG. 2.
Figure 4:
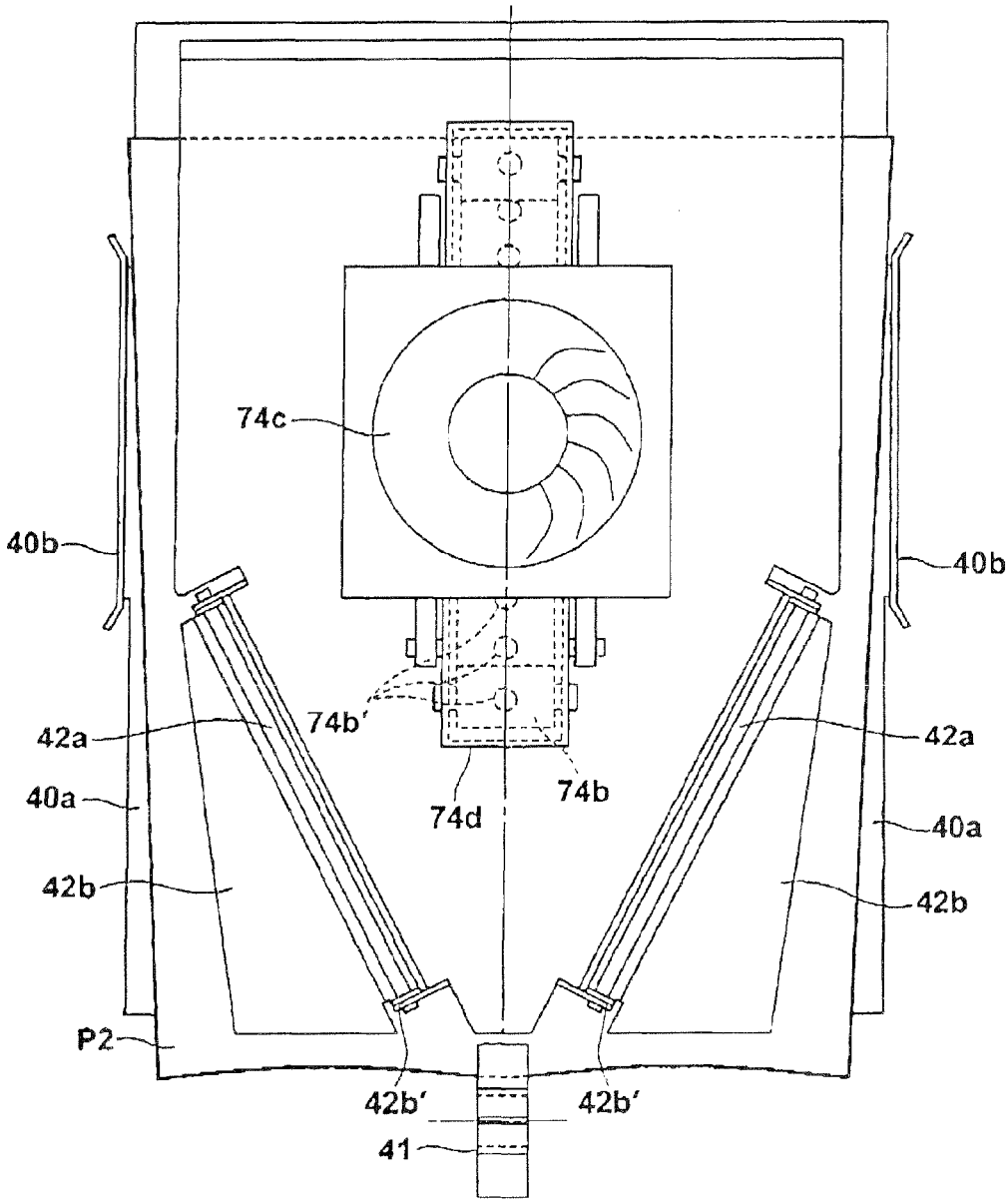
FIG. 4 is a diagram of the details of the main parts of the duplex screen printing apparatus, taken from the direction of arrow B of FIG. 2.

Hereinafter a duplex screen printing apparatus 1 according to a first embodiment of the present invention will be described with reference to the attached drawings. FIG. 1 is a diagram that illustrates the schematic construction of the duplex screen printing apparatus 1. FIG. 2 is a diagram of the details of the main parts of the duplex screen printing apparatus 1 of FIG. 1. FIG. 3 is a sectional view taken along line A-A of FIG. 2. FIG. 4 is a diagram of the details of the main parts of the duplex screen printing apparatus 1, taken from the direction of arrow B of FIG. 2.

As illustrated in FIG. 1, the duplex screen printing apparatus 1 of the first embodiment is equipped with: a housing 10;

a paper supply tray 2, which is provided on one side surface of the housing 10 (the left side surface in FIG. 1); a first screen printing section 3 (first printing means) for printing onto first sides A of sheets P1 which are supplied from the paper supply tray 2; a storage section 4 for storing a plurality of sheets P2, the first sides A of which have been printed on; a second screen printing section 5 (second printing means) for printing onto second sides B of the sheets P2, which have been stored in the storage section; and a paper output tray 6, provided at the other side surface of the housing 10 (the right side surface in FIG. 1), on which sheets P3, of which both the first sides A and the second sides B have been printed on, are stacked.

The duplex screen printing apparatus 1 is also equipped with: a first conveying section 7 (first conveying means) for conveying the sheets P1 from the paper supply tray 2 to the first screen printing section 3 and for conveying the sheets P2 from the first screen printing section 3 to the interior of the storage section 4; and a second conveying section 8 (second conveying means) for conveying the sheets P2 from the interior of the storage section 4 to the second screen printing section 5 and for conveying the sheets P3 from the second screen printing section 5 to the paper output tray 6.

The first conveying section 7 is provided in the housing 10, and is constituted by: first pickup rollers 71, which are provided at the upper portion of the housing 10 on the side thereof toward the sheets P1 on the paper supply tray 2; first timing rollers 72 for conveying the sheets P1, which have been picked up by the first pickup rollers 71, toward the first screen printing section 3 at predetermined timings; an inverting device 73 for inverting the sheets P2, the first sides A of which have been printed on, along an arcuate path such that the first sides A become the lower surfaces of the sheets P2; and a loading device 74 for loading the sheets P2, which have been inverted by the inverting device 73, into the storage section 4, and to cause a bottom edge supporting section 41 (to be described later) to support the sheets P2, as illustrated in FIG. 1 and FIG. 2.

The second conveying section 8 is also provided in the housing 10, and is constituted by: an ejecting device 81 for ejecting the sheets P2 from the bottom edge supporting section 41 (to be described later) within the storage section 4; second pickup rollers 82 for picking up the sheets P2 which have been ejected by the ejecting device 81; second timing rollers for sequentially conveying the sheets P2, which have been picked up by the second pickup rollers 82, toward the second screen printing section 5 at predetermined timings, and an output device 84 for output ting the sheets P3, the second sides B of which have been printed on by the second screen printing section 5, that is, of which both surfaces have been printed on, to the paper output tray 6.

Each of the loading device 74, the ejecting device 81, and the output device 84 is equipped with: a pair of pulleys 74*a*, 81*a*, and 84*a*, which are provided with predetermined intervals therebetween; annular conveyor belts 74*b*, 81*b*, and 84*b*, which are wound about the outer peripheries of the pairs of the pulleys 74*a*, 81*a*, and 84*a*, and move accompanying rotations of the pulleys 74*a*, 81*a*, and 84*a*; and suctioning fans 74*c*, 81*c*, and 84*c*, respectively.

The conveyor belts 74*b*, 81*b*, and 84*b* have pluralities of apertures 74*b*', 81*b*' and 84*b*' as illustrated in the conveyor belt 74*b* of FIG. 4 (apertures 81*b*' and apertures 84*b*' are not shown). Only portions of the conveyor belts 74*b*, 81*b*, and 84*b* and the pulleys 74*a*, 81*a*, and 84*a* that include the apertures 74*b*', 81*b*', and 84*b*' are exposed toward the exterior, and the remaining portions of the conveyor belts 74*b*, 81*b*, and 84*b* and the pulleys 74*a*, 81*a*, and 84*a* are housed within substantially sealed cases 74*d*, 81*d*, and 84*d* (case 84*d* is not shown) as illustrated in FIG. 3.

The fans 74*c*, 81*c*, and 84*c* are mounted in the cases 74*d*, 81*d*, and 84*d*, respectively. The fans 74*c*, 81*c*, and 84*c* expel the air within the cases 74*d*, 81*d*, and 84*d* toward the exteriors thereof, to generate suction force at the apertures 74*b*', 81*b*' and 84*b*' of the conveyor belts apertures 74*b*, 81*b* and 84*b*.

In each of the devices 74, 81, and 84 constructed in the manner described above, a motor (not shown) drives the pulleys 74*a*, 81*a*, and 84*a* to move the conveyor belts 74*b*, 81*b*, and 84*b*, as well as the fans 74*c*, 81*c*, and 84*c* to generate suction force at the apertures 74*b*', 81*b*', and 84*b*', to convey the sheets P while suctioning them.

As illustrated in FIG. 2, the inverting device 73 is equipped with four pulleys 73*a*, which are provided along an arcuate path, an annular conveyor belt 73*b*, which is wound about the outer peripheries of the pulleys 73*a*, and move accompanying rotations of the pulleys 73*a*; and a suctioning fan 73*c*, in a manner similar to the aforementioned devices 74, 81, and 84.

Note that the loading device 74, the ejecting device 81, the output device 84, and the inverting device 73 have the structures described above. Alternatively, the fans 73*c*, 74*c*, 81*c*, and 84*c* may be provided in the interiors of the conveyor belts 73*a*, 74*a*, 81*a*, and 84*a* to generate the suction force, for example. Any structure may be adopted, as long as the sheets P can be conveyed.

The loading device 74 may be constituted by a plurality of pairs of pulleys 74*a*, a plurality of conveyor belts 74*b*, and a plurality of fans 74*c* which are arranged in a series, and sheets may be suctioned and conveyed thereby. The ejecting device 81 and/or the output device 84 may also be of the same construction.

As illustrated in FIG. 1, the first screen printing section 3 is constituted by a first drum 31 and a first press roller 32. A peeling claw 33 for peeling the sheets P2 off the first drum 31 is provided downstream of the first drum 31, as illustrated in FIG. 2. A first ink cartridge (not shown) is provided within the first drum 31. A screen printing stencil M1, which has been thermally bored by a stencil plate maker based on input image data, is wound about the outer peripheral surface of the first drum 31. The first timing rollers 72 are synchronized with the rotation of the drum 31, and send the sheets P1 between the first drum 31 and the first press roller 32. The first press roller 32 presses the first sides A of the sheets P1, that is, the upper surfaces A, against the screen printing stencil M1, to perform screen printing onto the first sides A.

The second screen printing section 5 is constituted by a second drum 51 and a second press roller 52, similar to the first screen printing section 3. A peeling claw 53 for peeling the sheets P3 from the second drum 51 is provided downstream from the second drum 51. A second ink cartridge (not shown) is provided within the second drum 51. A screen printing stencil M2 is wound about the outer peripheral surface of the second drum 51. The second timing rollers 83 are synchronized with the rotation of the drum 51, and send the sheets P2, of which the first sides A have been printed on, which have been inverted by the inverting device 72, and which have been stored in the storage section 4, between the second drum 51 and the second press roller 52. The second press roller 52 presses the second sides B of the sheets P2, that is, the upper surfaces B, against the screen printing stencil M2, to perform screen printing onto the second sides B.

The storage section 4 temporarily stores a plurality of the sheets P2, of which the first sides A have been printed on by the first screen printing section 3, prior to printing being performed onto the second sides B thereof by the second screen printing section 5. The characteristic feature of the present invention is that the storage section 4 is equipped with a holding mechanism that holds the plurality of sheets P2 in an overlapped state with predetermined intervals therebetween.

The holding mechanism may be of any structure as long as it holds the plurality of sheets P2, the first sides A of which have been printed on, in an overlapped state with predetermined intervals therebetween, and various structures may be employed. Examples of specific structures include: that which supports the bottom edges of the sheets P2 while holding them in an upright state; that which clamps each of the sheets P2; and that which holds each of the sheets P2 by suction.

The storage section 4 has a sheet insert position, at which the sheets P2 which are conveyed by the first conveying section 7 enter the storage section 4, and a sheet discharge position, at which the stored sheets P2 are passed on to the second conveying section 8. The sheet insert position and the sheet discharge position are spaced a predetermined distance apart from each other. The holding mechanism sequentially holds each of the sheets P2 that enter the storage section 4 from the sheet insert position, and moves each of the sheets P2 toward the sheet discharge position while the sheets are in an overlapped state with predetermined intervals therebetween, to output the sheets P2 from the storage section 4 and supply them for printing onto the second sides B.

As illustrated in FIG. 1, in the storage section 4 of the first embodiment is provided in an inclined orientation, with a sheet inlet opening for the sheets P2, which have been conveyed by the first conveying section 7, and the sheet outlet opening, through which the sheets P2 are sent to the second conveying section 8, being provided toward the upper end thereof. The storage section 4 is equipped with a holding mechanism that holds the sheets P2 in an upright and overlapped state with predetermined intervals therebetween, with curls imparted thereto such that the first sides A are toward the interiors of concave shapes which are formed in horizontal cross sections (cress sections in the direction perpendicular to the vertical directions of the sheets P2, which are upright in an inclined direction).

Figure 7:
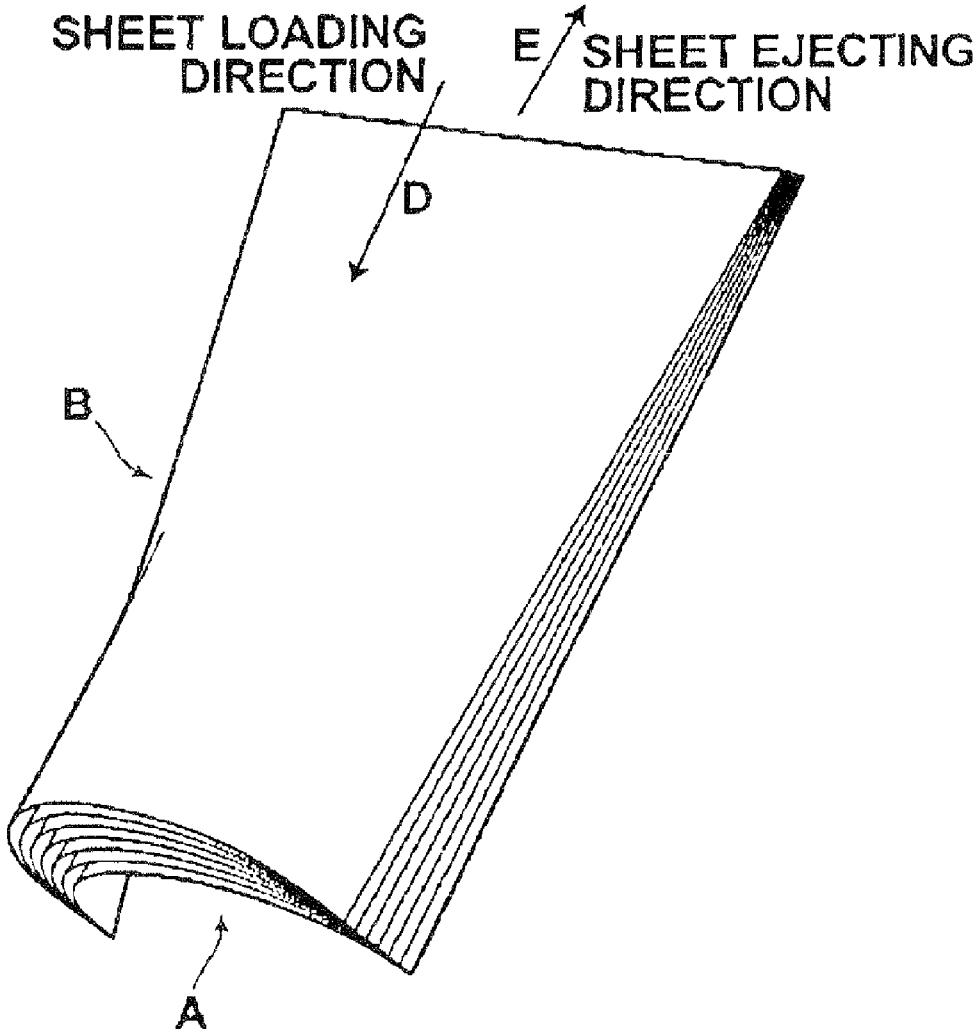
FIG. 7 is a diagram that illustrates the state of sheets within a storage section.

As illustrated in FIG. 2, the holding mechanism of the first embodiment is equipped with: a supporting plate 40*a*, which is a support that supports the printed first sides A of the sheets P2 from obliquely below; side surface guiding plates 40*b*, which are provided substantially perpendicular to the supporting plate 40*a* at both side edges thereof (the edge toward the viewer and the edge away from the viewer in the depth direction of the drawing sheet), that guide the sheets P2 onto the supporting plate 40*a*; a covering plate 40*c* that covers the imprinted second sides B of the sheets P2 from obliquely above; a bottom edge supporting section 41 (bottom edge supporting means) that supports the bottom edges of the plurality of sheets P2 in the sequential order in which they are loaded into the storage section 4 with predetermined intervals therebetween; and curl imparting sections 42 (curl imparting means) that impart curls to the sheets P2 such that the printed first sides A thereof are toward the interiors of concave shapes which are formed in horizontal cross sections, as illustrated in FIG. 3 and FIG. 7.

Figure 5:
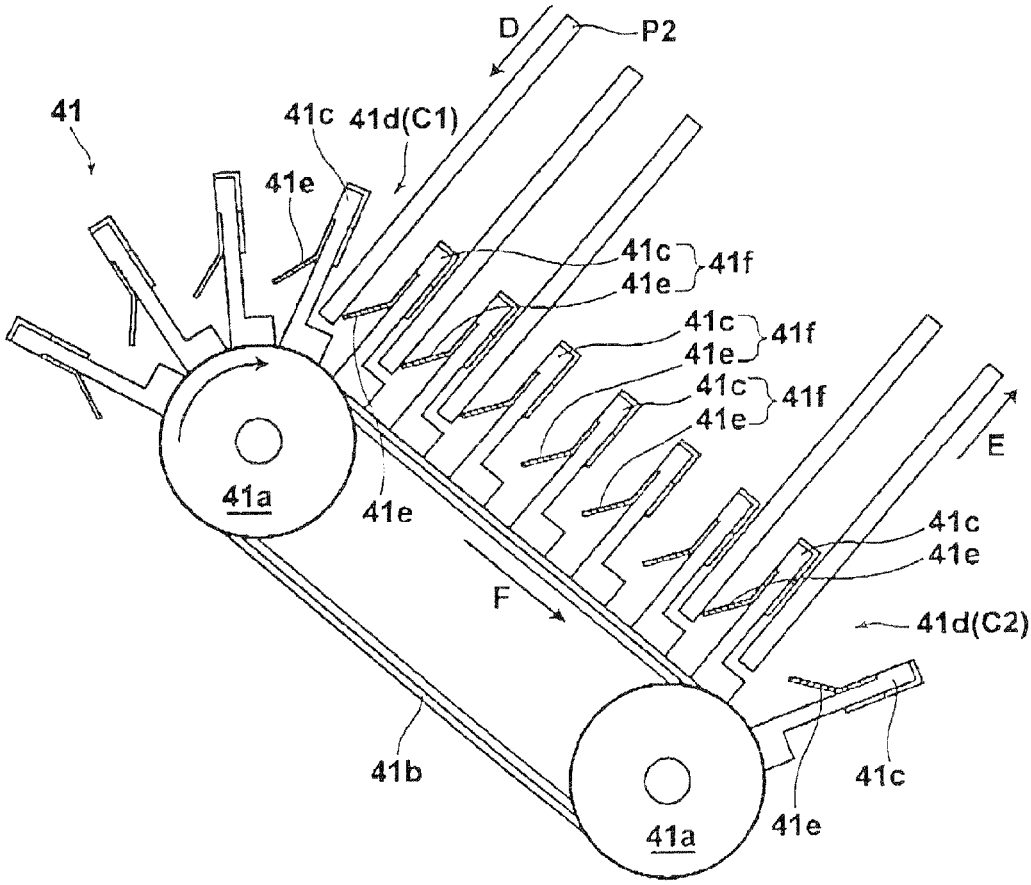
FIG. 5 is an enlarged view of the details of a bottom edge supporting section of FIG. 2.
Figure 6:
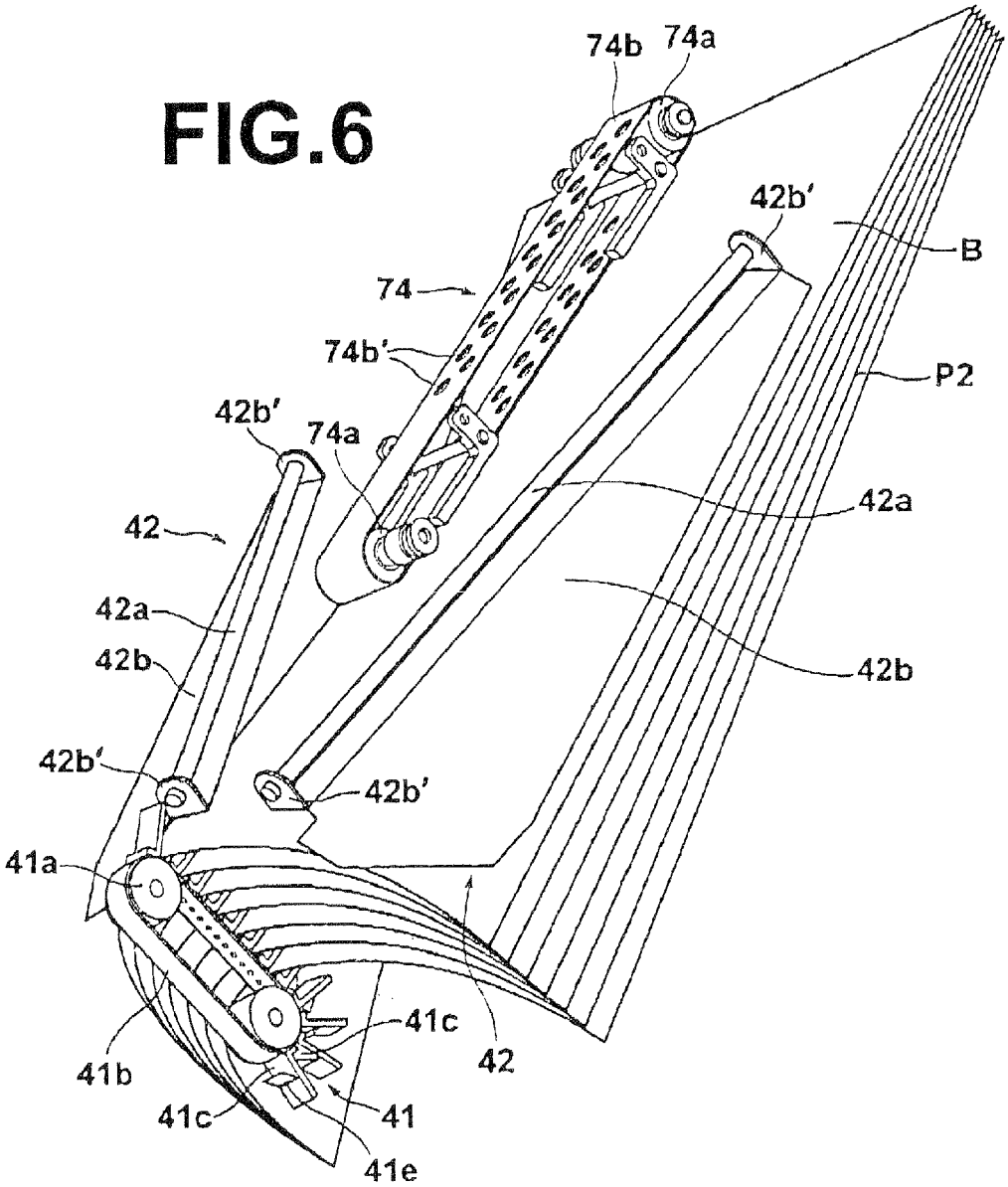
FIG. 6 is an enlarged perspective view of the details of the main parts of FIG. 2.

Note that as illustrated in FIG. 3, the case 74*d* of the leading device 74 is mounted onto the covering plate 40*c*, and the case 81*d* of the ejecting device 81 is mounted onto the supporting plate 40*a*. The covering plate 40*c* and the supporting plate 40*a* are provided with openings (not shown) that expose the conveyor belt 74*b* and the conveyor belt 81*b*, respectively. FIG. 5 is an enlarged view of the details of the bottom edge supporting section 41 of FIG. 2. FIG. 6 is an enlarged perspective view of the details of the main parts of FIG. 2. FIG. 7 is a diagram that illustrates the state of the sheets P2 within the storage section 4. Note that the details of the outer peripheral surface of a conveyor belt 41*b* at one side are omitted for the sake of convenience.

As illustrated in FIG. 2 and FIG. 5, the bottom edge supporting section 41 is equipped with a pair of pulleys 41*a*, which are provided with an interval therebetween; an annular conveyor belt 41*b*, which is wound about the outer peripheries of the pair of pulleys 41*a* and move accompanying rotation of the pulleys 41*a* which are driven by a motor (not shown); and a plurality of plates 41*c*, which are erected with predetermined intervals therebetween on the entirety of the outer peripheral surface of the conveyor belt 41*b*. The bottom edge supporting section 41 constructed in this manner is provided such that the direction that connects the pair of pulleys 41*a*, that is, the conveying direction of the conveyor belt 41*b* (the direction indicated by arrow F in FIG. 5, that is, the direction that the portion of the conveyor belt 41*b* that supports the sheets P2 at the upper sides of the pulleys 41*a* moves in) is substantially perpendicular to the loading direction (the direction indicated by arrow D) and the ejecting direction (the direction indicated by arrow E) of the sheets P2.

As illustrated in FIG. 5, each of the plurality of plates 41*c* is equipped with an elastically deformable claw piece 41*e* that extends toward an adjacent plate 41*c* toward the upstream direction in the conveyance direction of the conveyor belt 41*b*. Recesses 41*d* are formed between pairs of adjacent plates 41*c*. When the sheets P2 are inserted into the recesses 41*d* with the printed first sides A obliquely downward (the direction toward the right in FIG. 2 and FIG. 5), the claw pieces 41*e* and the adjacent plates 41*c* reward the upstream side clamp the center of the bottom edge of the sheets P2. Thereby, the plurality of sheets P2 are held in an overlapped state with predetermined intervals therebetween. At this time, the claw pieces 41*e* of downstream side plates 41*c* and plates 41*c* toward the upstream side thereof become clamping sections 41*f* for clamping individual sheets P2.

At portions of the conveyor belt 41*b* in a linear state, adjacent plates 41*c* and 41*c* become substantially parallel, and the space between the tip (lower ends) of the claw piece 41*e* of a downstream plate 41*c* and an adjacent plate 41*c* upstream thereof becomes smaller than the thickness of the sheet P2. Therefore, when the sheets P2 are inserted into the recesses 41*d*, the claw pieces 41*e* elastically deform by the sheets P2 toward the plates 41*c* that they are mounted on, and as a result, the claw pieces 41*e* elastically press the sheets P2 against the upstream side plates 41*c* to clamp the sheets P2. Meanwhile, at portions of the conveyor belt 41*b* on the pulleys 41*a*, which are in a curved state, adjacent plates 41*c* and 41*c* are no longer parallel, and the tips (upper ends) are further apart than the lower ends thereof. At these portions, the space between the tip of the claw piece 41*e* of a downstream plate 41*c* and an adjacent plate 41*c* upstream thereof becomes greater than the thickness of the sheet P2, thereby enabling the sheet P2 to be released.

In the storage section 4, the sheet insert position C1 (indicated by arrow D in FIG. 2), at which sheets are loaded into the storage section 4 after being conveyed by the first conveying section 7, and the sheet discharge position C2 (indicated by arrow E in FIG. 2), at which the stored sheets P2 are sent to the second conveying section 8 and ejected from the storage section 4 by the second conveying section 8, are set a predetermined distance apart along the conveyance direction of the conveyor belt 41*b*. The bottom edge supporting section 41 is provided such that each of the pair of pulleys 41*a* is positioned corresponding to the sheet insert position C1 and the sheet discharge position C2. More specifically, the sheet insert position C1 is positioned slightly toward the exterior (toward the left in FIG. 2) with respect to the center of the pulley 41*a* which is positioned in the upstream direction of the conveyance direction of the conveyor belt 41*b* (the pulley toward the left in FIG. 2). In addition, the sheet discharge position C2 is positioned slightly toward the exterior (toward the right in FIG. 2) with respect to the center of the pulley 41*a* which is positioned in the downstream direction of the conveyance direction of the conveyor belt 41*b* (the pulley toward the right in FIG. 2).

Thereby, at least the upstream plate 41*c* of a clamping section 41*f* at the sheet insert position C1 is positioned on the portion of the conveyor belt 41*b* which is curved along the upstream pulley 41*a*. Therefore, the upper ends of the pair of plates 41*c* that constitute the clamping section 41*f* are further apart, the clamping section 41*f* is in an open state, and it is possible for the bottom edge of a sheet P2 to be received in the recess 41*d* of the clamping section 41*f*. Similarly, at least the downstream plate 41*c* of a clamping section 41*f* at the sheet discharge position C2 is positioned on the portion of the conveyor belt 41*b* which is curved along the downstream pulley 41*a*. Therefore, the upper ends of the pair of adjacent plates 41*c* that constitute the clamping section 41*f* are further apart, the clamping section 41*f* is in an open state, and it is possible for clamping of the sheet P2 to be released to enable the sheet P2 to be drawn out from the clamping section 41*f*.

When a motor (not shown) drives the pulleys 41*a* to rotate in the clockwise direction, the conveyor belt 41*b* moves in the clockwise direction. The loading device 74 loads a sheet P2 into the recess 41*d* of a clamping portion 41*f* which is positioned at the sheet insert position and in an open state, and positions the bottom edge of the sheet P2 between the plate 41*c* and the claw piece 41*e* of the clamping portion 41*f*. Each time that the conveyor belt 41*b* moves for a space of a single recess 41*d*, a sheet P2 is sequentially loaded into a new recess 41*d* which is positioned at the sheet insert position C1.

After the sheets P2 are loaded into the clamping sections 41*f* at the sheet insert position C1, the conveyor belt 41*b* moves to position the clamping sections 41*f* on the portion of the conveyor belt 41*b* in the linear state. At this position, the clamping section 41*f* assumes the closed state, and thereby the bottom edges of the sheets P2 are positively held between the claw pieces 41*e* and the plates 41*c*.

When the clamping sections 41*f* are positioned at the sheet discharge position C2 by further movement of the conveyor belt 41*b*, the clamping sections 41*f* assume the open state, and the ejecting device 81 conveys the sheets P2 out from between the claw pieces 41*e* and the plates 41*c*. The ejecting device 81 sequentially conveys subsequent sheets P2 out of the storage section 4 each time that the conveyor belt 41*b* moves for a space of a single recess 41*d*.

As illustrated in FIG. 6, the curl imparting sections 42 are provided at both sides of the loading device 74, which is mounted on the covering plate 40*c* to suction and convey the centers of the sheets P2 in the horizontal direction. As illustrated in FIG. 3 and FIG. 6, each of the curl imparting sections 42 is equipped with: a fulcrum shaft, of which both ends are fixed to mounting plates erected on the covering plate 40*c*; supporting plates 42*b*' which are rotatable in the directions indicated by arrows M of FIG. 3 with the fulcrum shaft 42*a* as the center of rotation; and a guide member 42*b* that extends obliquely downward in a wing like manner and rotates integrally with the supporting plates 42*b*'.

When the sheets P2 are conveyed to the sheet insert position C1 by the loading device 74 with the printed surfaces A obliquely downward, they are loaded into the storage section 4 along the lower surfaces of the guide members 42*b*. Therefore, the bottom edges of the sheets P2 are inserted into the clamping sections 41*f* of the bottom edge supporting section 41 while the side portions of the sheets P2 are pressed more downward compared to the central portions thereof, that is, toward the printed first sides A. Thereby, bottom edges of the sheets P2 are supported by the bottom edge supporting section 41 in a curled state with the first sides A toward the interiors of concave shapes which are formed in horizontal cross sections thereof, as illustrated in FIG. 7.

When the conveyor belt 41*b* of the bottom edge supporting section 41 moves, the sheets P2 separate from the lower surfaces of the guide members 42*b* in a curled state as described above. Then, a next sheet P2 is loaded into the storage section 4 along the lower surfaces of the guide members 42*b*. The sheets P2 which have separated from the lower surfaces of the guide members 42*b* are conveyed toward the sheet discharge position C2. At the sheet discharge position C2, the first sides A are held by suction onto the ejecting device 81 and conveyed toward the second pickup rollers 82.

Note that the guide members 42*b* are rotatable in the directions indicated by the arrows M of FIG. 3, with the fulcrum shafts 42*a* as the centers of rotation. Therefore, in cases that the sheets P are thick or rigid, the guide members 42*b* may be rotated in the directions indicated by the arrows M to decrease the angles θ formed by the covering plate 40*c* and the guide members 42*b*. Thereby, the lower surfaces of the guide members 42*b* can be moved in the conveyance direction of the sheets P2 (the direction indicated by arrow F of FIG. 5). In cases that the sheets P are thin or soft, the guide members 42*b* may be rotated in the directions indicated by the arrows M to increase the angles θ formed by the covering plate 40*c* and the guide members 42*b*. Thereby, the lower surfaces of the guide members 42*b* can be moved in a direction opposite the conveyance direction of the sheets P2. Accordingly, the amount of pressing which is performed when imparting curls onto the sheets P2 can be adjusted corresponding to the quality of the sheets P2.

The plurality of sheets P2, of which the first sides A have been printed on, are held in the storage section 4 in an overlapped state with predetermined intervals therebetween. Thereby, staining of the sheets P2 due to rubbing of printed surfaces or seepage of ink can be prevented. Note that in the first embodiment, only the centers of the bottom edges of the plurality of sheets P2 are held. Therefore, there are cases in which the upper edges and/or the left and right edges of the sheets P2 contact other sheets P2. However, this contact is due to the weight of the sheets P2 themselves, as illustrated in FIG. 3, and the printed surfaces A of the sheets P2 do not rub against the other sheets P2. Therefore, the possibility that the sheets P2 will become stained is low. In addition, it is often the case that printing is not performed at the upper edges and the left and right edges of sheets, and the possibility that the sheets P2 will become stained is low from this perspective as well.

The ink on the printed first sides A can be dried efficiently, because the first sides A do not contact any other sheets P2 while the conveyor belt 41*b* conveys the sheets P2 from the sheet insert position C1 to the sheet discharge position C2.

The plurality of sheets P2 are stored one by one with intervals therebetween while the conveyor belt 41*b* conveys the sheets P2 from the sheet insert position C1 to the sheet discharge position C2. Therefore, the necessity of providing a separating mechanism to peel sheets, the surfaces of which are in close contact, from each other in order to prevent simultaneous conveyance of multiple sheets is obviated.

Thereby, staining of the sheets P2, which is caused by the printed surfaces rubbing against other sheets when separating the sheets with a separating mechanism, can be prevented.

In addition, the sheets P2 are conveyed from the sheet insert position C1 to the sheet discharge position C2 in a state in which the centers of the bottom edges thereof are gripped by the clamping sections 41*f*. Therefore, the positional accuracy of the sheets P2 at the sheet discharge position C2 can be improved, compared to cases in which sheets are stacked by dropping due to their own weight.

The holding mechanism of the storage section 4 of the first embodiment is of a simple structure that supports only the bottom edges of the sheets P2. Therefore, the space occupied by the storage section 4 can be comparatively small.

The sheets P2 are held in a state in which they are curled by the guide members 42 such that their cross sections in the horizontal direction are curved. Therefore, curling of the sheets P2 in the vertical cross section, that is, curling along the conveyance direction, due to moisture absorption by the sheets P2 becomes unlikely to occur, even in cases that the amount of ink transferred onto the first sides A is comparatively great and the liquid content in the sheets P2 is high. Accordingly, paper jams along the conveyance path caused due to curling along the conveyance direction can be prevented, and stable conveyance is enabled, even of sheets, of which one surface has been printed on. Therefore, the duplex screen printing apparatus 1 is capable of printing at high paper supply speeds.

Further, the sheets P2 are curled such that their cross sections in the horizontal direction are curved, as described above. Therefore, folding, in which the sheets become curved in the vertical cross section becomes unlikely to occur, even if the sheets are held in the upright state by holding their bottom edges only, and the upright states of the sheets can be maintained solely by supporting the bottom edges.

Figure 8:
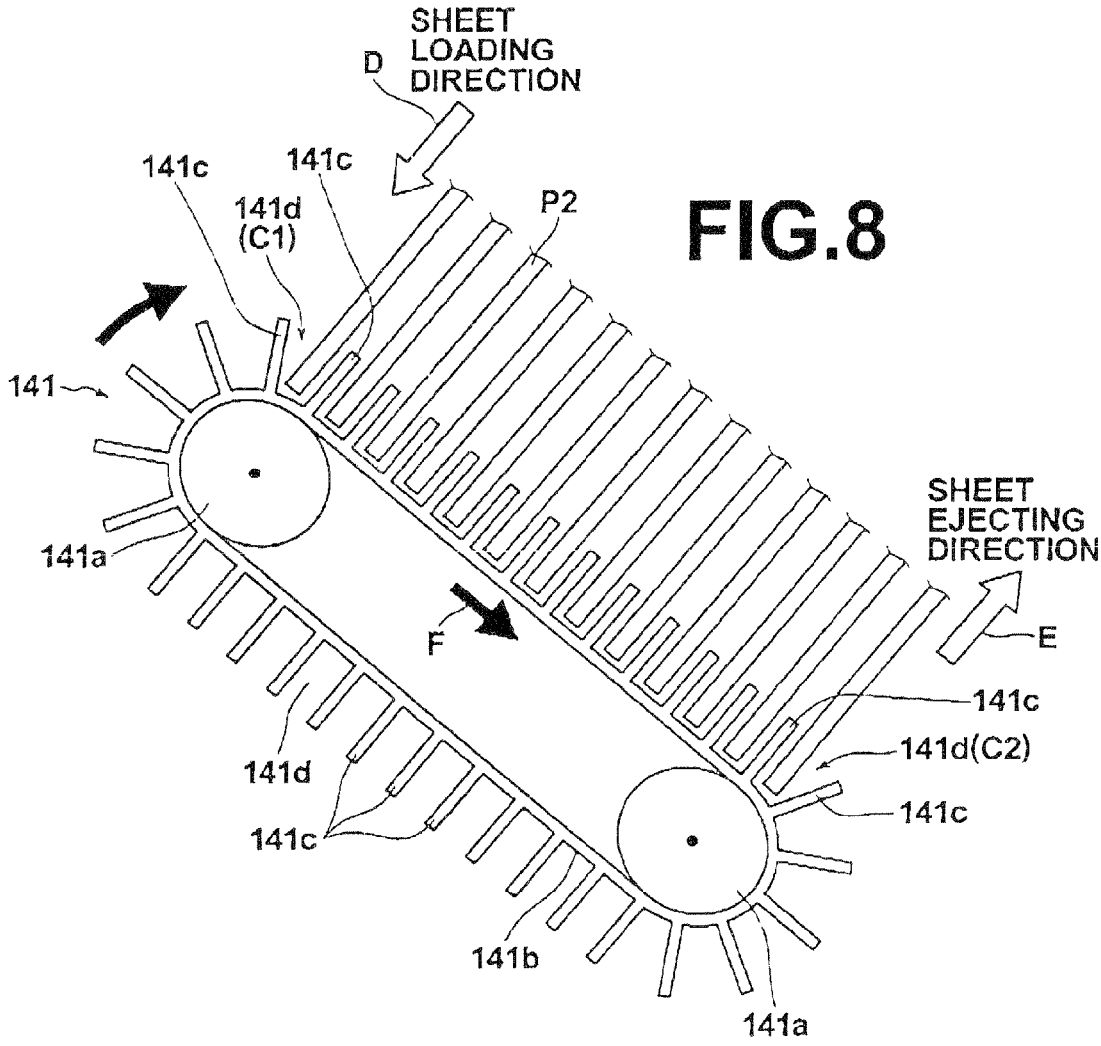
FIG. 8 is a side view that illustrates a bottom edge supporting section according to a second embodiment of the present invention.
Figure 9:
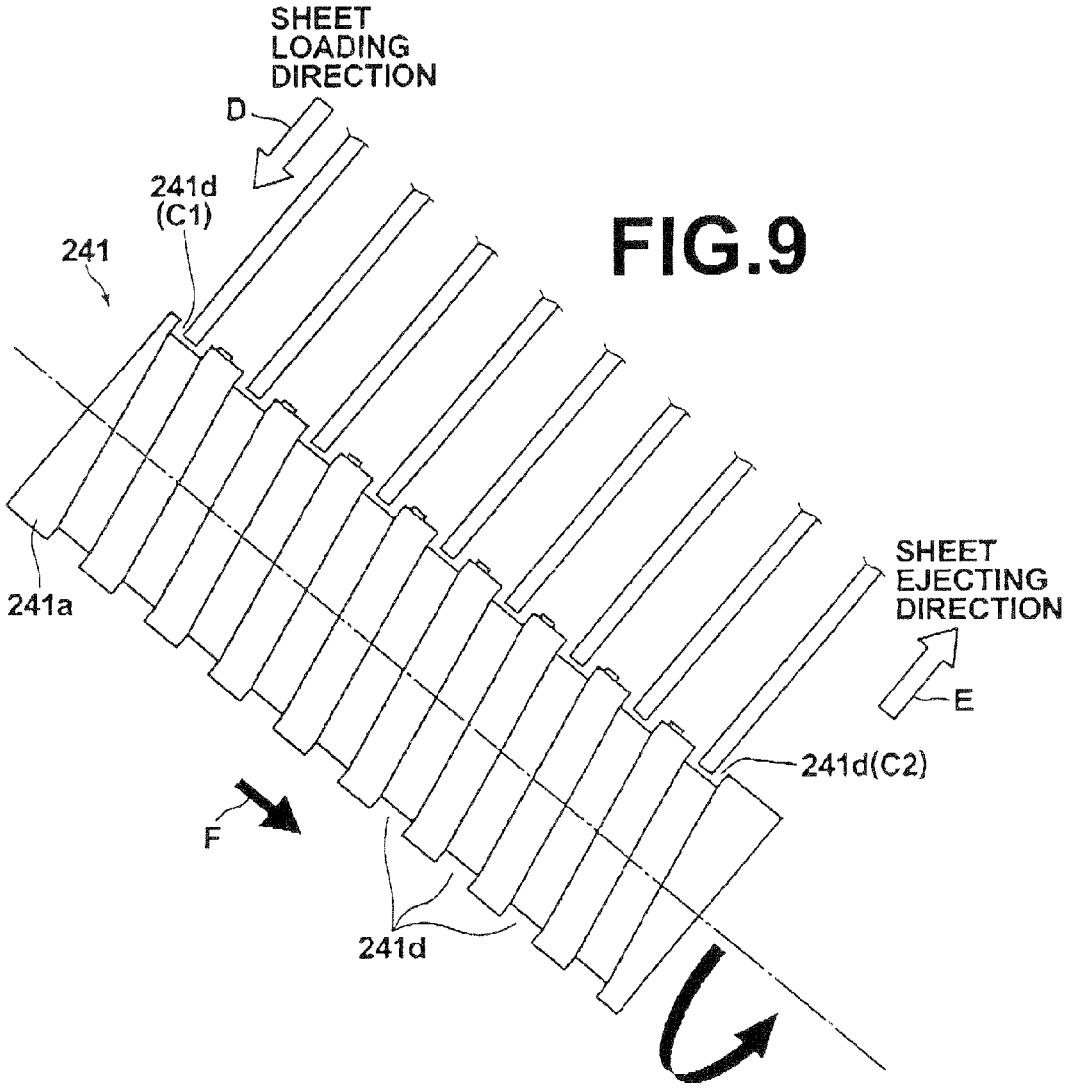
FIG. 9 is a side view that illustrates a bottom edge supporting section according to a third embodiment of the present invention.

Note that in the first embodiment, the bottom edge supporting section 41 was described as having the construction described above. However, the bottom edge supporting section 41 is not limited to that described above, and alternate structures may be adopted. FIG. 8 is a side view that illustrates a bottom edge supporting section 141 according to a second embodiment of the present invention. FIG. 9 is a side view that illustrates a bottom edge supporting section 241 according to a third embodiment of the present invention.

The bottom edge supporting section 141 of the second embodiment differs from the bottom edge supporting section 41 of FIG. 5 in that the clamping sections 41*f* are not provided. As illustrated in FIG. 8, a plurality of protrusions 141*c* are erected on the entire periphery of a conveyor belt 141*b*. The centers of the bottom edges of the sheets P2 abut the bottom surfaces of recesses 141*d* formed by adjacent protrusions 141*c*. The recesses 141*d* are configured to support the bottom edges of the sheets P2.

In the bottom edge supporting section 141 of the second embodiment, a motor (not shown) rotates pulleys 141*a* to move the conveyor belt 141*b* in the clockwise direction, in a manner similar to that of the bottom supporting section 41 of FIG. 5. Thereby, the recesses 141*d*, that is, the sheets P2, can be conveyed in the direction indicated by arrow F from the sheet insert position C1 to the sheet discharge position C2, one by one.

As illustrated in FIG. 9, the bottom edge supporting section 241 of the third embodiment is constituted by a threaded shaft 241*a* that extends in a direction which is substantially perpendicular to the loading/ejecting directions of the sheets P2 (the directions indicated by arrows D and E). Thread grooves 241*d* are formed in the outer peripheral surface of the threaded shaft 241*a*. A motor (not shown) rotates the threaded shaft 241*d* clockwise as viewed from the end toward the sheet insert position C1, to move the portions of the thread grooves 241*d* positioned on the upper side of the threaded shaft 241*a* from the sheet insert position C1 to the sheet discharge position C2.

The sheets P2 which are loaded into the sheet insert position C1 of the storage section 4 are supported by a thread groove 241*d* on the upper side of the threaded shaft 241*a* positioned at the sheet insert position C1. New thread groove portions sequentially appear at the sheet insert position C1 due to rotation of the threaded shaft 241*a*. The bottom edges of subsequently loaded sheets P2 are supported by the new thread grooves, and the sheets P2 which are supported by each of the thread grooves are moved toward the sheet discharge position C2 accompanying the movement of the thread grooves.

The bottom edge supporting sections 141 and 241 according to the second and third embodiments described above are capable of holding pluralities of sheets P2 within the storage section 4 in an overlapped state with predetermined intervals therebetween in cooperation with the curl imparting section 42, similarly to the bottom edge supporting section 41 of the first embodiment.

Note that in the first embodiment, the curl imparting section 42 has the construction described above. However, the curl imparting section 42 is not limited to this configuration, and may be of any structure as long as curls are imparted onto the sheets P2 such that the first sides A thereof are toward the interiors of concave shapes which are formed in horizontal cross sections. For example, a structure may be adopted wherein the left and right side portions of the sheets P2 are suctioned from the side of the first sides A.

Next, the series of operations performed by the duplex screen printing apparatus 1 according to the first embodiment will be described. Note that each operation is performed based on a command issued by a control section (not shown), which is provided in the housing 10.

In the duplex screen printing apparatus 1, the pickup rollers 71 sequentially pick up the sheets P1 which are placed on the paper supply tray 2, the picked up sheets P1 are sequentially conveyed to the first screen printing section 3 by the first timing rollers 72, as illustrated in FIG. 1. At the first screen printing section 3, the first drum 31 is rotated while the conveyed sheets P1 are pressed against the first drum 31 by the first press roller 32 one by one. Thereby, the image of the screen printing stencil which is wound about the first drum 31 is sequentially printed on the first sides A of the sheets P1.

Next, the inverting device 73 sequentially conveys the sheets P2 along the arcuate path with the printed first sides A on the upper side, while suctioning the second sides B. Thereby, the sheets P2 are inverted such that the first sides A are on the lower side, and conveyed toward the storage section 4. Then, the loading device 74 sequentially loads the sheets P2 which have been sequentially conveyed by the inverting device 73 into the storage section 4 while suctioning the central portions of the upper surfaces thereof, that is, the second sides B, as illustrated in FIG. 2. At this time, the sheets P2 which are loaded into the storage section 4 by the loading device 74 enter the storage section 4 while the left and right sides of the second sides B abut the lower surfaces of the aforementioned guide members 42*b*.

The sheets P2 which are loaded into the storage section 4 by the loading device 74 in the manner described above are inserted into the recesses 41*d* at the sheet insert position C1, as illustrated in FIG. 5. At this time, a motor (not shown) rotates the pulleys 41*a* synchronized with the loading of the sheets P2 by the loading device 74 such that the recesses 41*d* are positioned at the sheet insert position C1. Therefore, the sheets P2 which are loaded into the storage section 4 at the sheet insert position C1 are sequentially inserted into new recesses 41*d* which are positioned at the sheet insert position C1. The sheets P2 are moved in the conveyance direction indicated by arrow F.

The bottom edge supporting section 41 supports the bottom edges of the sheets P2 which are loaded into the recesses 41*d* at the sheet insert position C1. The clamping sections 41*f* clamp the centers of the bottom edges of the sheets P2 as the conveyor belt 41*b* moves, as described above. Therefore, the plurality of sheets P2 which are loaded into the storage section 4 at the sheet insert position C1 can be clamped by the clamping sections 41*f* one by one.

The left and right side portions of the upper surfaces, that is, the second sides B, of the sheets P2, which are supported by the recesses 41*d* at the sheet insert position C1, are pressed downward, that is, toward the side of the first sides A, by the guide members 42*b*, as illustrated in FIG. 6. Therefore, the sheets P2 assume a curled state having the first sides A toward the interior of the concave curl, as illustrated in FIG. 7. The sheets P2 move along with the conveyor belt 41*b* while maintaining the curled state, by the centers of their bottom edges being clamped by the clamping sections 41*f*.

When the plurality of sheets P2, which are clamped one by one by the clamping sections 41*f*, reach the sheet discharge position C2 due to movement of the conveyor belt 41*b*, they are released from the clamping sections 41*f*, as described above. At this time, the pulleys 81*a* and the fan 81*c* of the ejecting device 81 are driven synchronized with the arrival of the sheets P2 at the sheet discharge position C2, to convey the sheets P2, which have been released from the clamping sections 41*f*, toward the second screen printing section 5, while suctioning the lower surfaces thereof, that is, the first sides A.

At this time, the ink which has been transferred onto the first sides A of the sheets P2 can be dried during the time necessary for movement from the sheet insert position C1 to the sheet discharge position C2, that is, during the storage time within the storage section 4. Therefore, staining of the surfaces of the sheets P2 due to contact with the conveyor belt 81*b* when the ejecting device 81 conveys the sheets P2 by suctioning the first sides A can be prevented.

Note that the storage time can be controlled to be extended or shortened based on the print rate of the first sides A of the sheets P2. In the case that the print rate of the first sides A is high, the amount of ink transferred thereto is great. Therefore, the amount of storage time can be increased. In the case that the print rate of the first sides A is low, the amount of ink transferred thereto is small. Therefore, the amount of storage time can be decreased. The term "print rate" refers to the percentage of a printed area with respect to the entire area of the first surface A of a sheet P2. For example, the print rate is the percentage of black image data with respect to the entirety of black and white binary image data that represent an image to be printed by the first printing means (the black image data is where apertures are formed in a screen printing stencil, and the white image data is where no apertures are formed in the screen printing stencil) in the case of screen printing.

Figure 10:
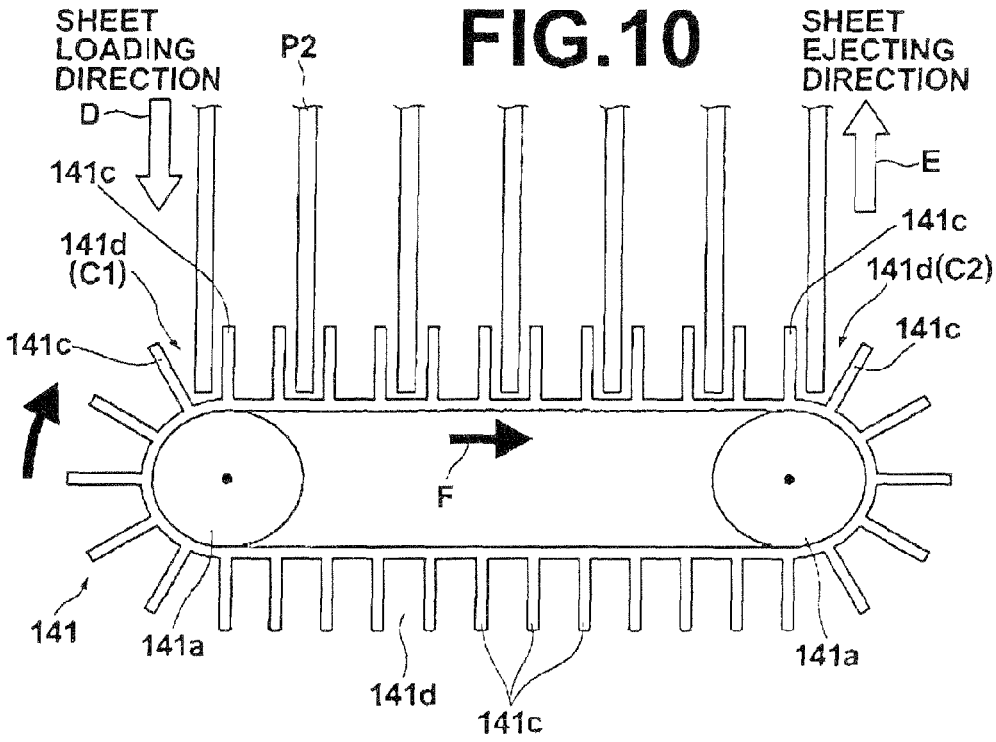
FIG. 10 is a side view that illustrates an alternate operating state of the bottom edge supporting section of FIG. 8.
Figure 11:
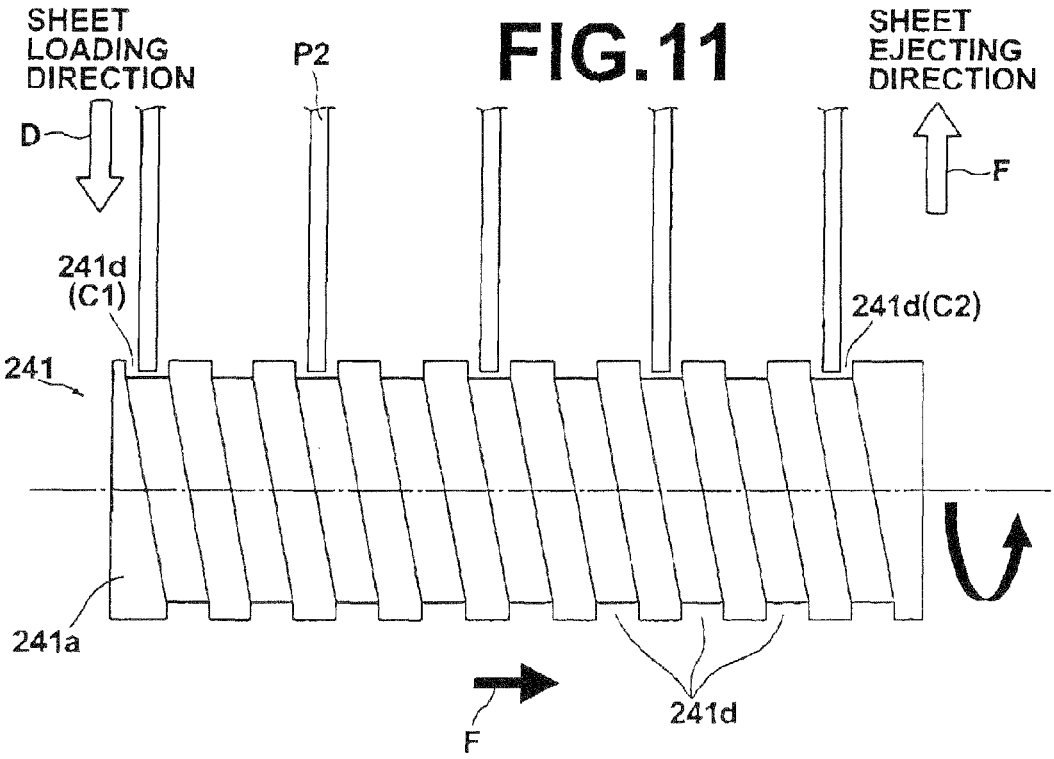
FIG. 11 is a side view that illustrates an alternate operating state of the bottom edge supporting section of FIG. 9.

FIG. 10 is a side view that illustrates an alternate operating state of the bottom edge supporting section 141 of FIG. 8. FIG. 11 is a side view that illustrates an alternate operating state of the bottom edge supporting section 241 of FIG. 9.

In the case that the storage section 4 is equipped with the bottom edge supporting section 141 according to the second embodiment, the print rate of the first screen printing section 3 is calculated prior to initiation of duplex printing. In the case that the print rate is less than or equal to a predetermined value, that is, when the amount of time necessary for drying is comparatively small, the speed of the conveyor belt 141*b*, that is, the conveyance speed of the sheets P2, may be increased to twice that of the case illustrated in FIG. 8, thereby causing the sheets P2 to be held in every other recess 141*d*, for example, as illustrated in FIG. 10. Note that the speed of the conveyor belt 141*b* can be changed by controlling a motor (not shown) to change the driving speed of the pulleys 141*a*.

In the case that the storage section 4 is equipped with the bottom edge supporting section 241 according to the third embodiment, and the print rate is less than or equal to a predetermined value, the movement speed of the threaded grooves 241*d*, that is, the conveyance speed of the sheets P2, may be increased to twice that of the case illustrated in FIG. 9, thereby causing the sheets P2 to be held in every other thread groove 241*d*, as illustrated in FIG. 11. Note that the movement speed of the thread grooves 241*d* can be changed by controlling a motor (not shown) to change the rotating speed of the threaded shaft 241*a*.

When the bottom edge supporting section 41 is driven such that the sheets P2 are held in every other recess or every other thread groove, the conveyance speed of the sheets P2 becomes faster. Therefore, the amount of time that the sheets P2 are stored in the storage section 4 decreases, and the sheets P2 can be ejected at the sheet discharge position C2 while omitting unnecessary drying time.

The movement speed of the conveyor belt 141*b* and the movement speed of the thread grooves 241*d* can be changed simply by controlling motors. Therefore, the storage time, that is, the drying time, can be controlled without complex control structures.

Note that the drying time can be controlled in a manner similar to the case that the storage section 4 is equipped with the bottom edge supporting section 141 of the second embodiment, in the case that the storage section 4 is equipped with the bottom edge supporting section 41 illustrated in FIG. 5 as well.

The ejecting device 81 ejects the sheets P2, of which the ink transferred onto the first sides A has dried as described above, from the storage section 4. Then, the second pickup rollers 82 sequentially picks up the sheets P2 which are conveyed by the ejecting device 81. The second timing rollers (3 sequentially conveys the picked up sheets P2 to the second screen printing section 5 at predetermined timings. The second screen printing section 5 sequentially prints the image of the screen printing stencil M2 which is wound about the second drum 51 onto the upper surfaces of the sheets, that is, the second sides B.

Thereafter, the output device 84 conveys the sheets P3 to the paper output tray 6 with the second sides B on the upper side, while suctioning the first sides A.

Next, a duplex screen printing apparatus according to a fourth embodiment of the present invention will be described. The duplex screen printing apparatus of the fourth embodiment is equipped with the loading device 74 of the duplex screen printing apparatus 1 of the first embodiment, which is further equipped with a separating member 75 (separating means) that separates the sheets P2 which are suctioned onto the conveyor belt 74*b* by the fan 74*c*. FIG. 12A through FIG. 12D are diagrams for explaining the steps from loading the sheets P2 into and ejecting the sheets P2 from the storage section 4 of the duplex screen printing apparatus of the fourth embodiment. Note that the clamping sections 41*f* illustrated in FIG. 12A through FIG. 12D are similar to the clamping sections 41*f* of the first embodiment, although the drawings thereof are different for the sake of convenience.

As illustrated in FIG. 12A through FIG. 12D, the separating member 75 is provided in the vicinity of the conveyor belt 74*b* that suctions and conveys the sheets P2. The separating member 75 is constituted by: a rotating shaft 75*a* which is rotated by a motor (not shown); and a separating claw 75*b*, of which one end is connected to the rotating shaft 75*a* and which rotates along with the rotating shaft 75*a*. The separating operation performed by the separating member 75 is controlled by a separating operation control section (not shown, separating operation control means). The separating operation will be described below.

Figure 12A:
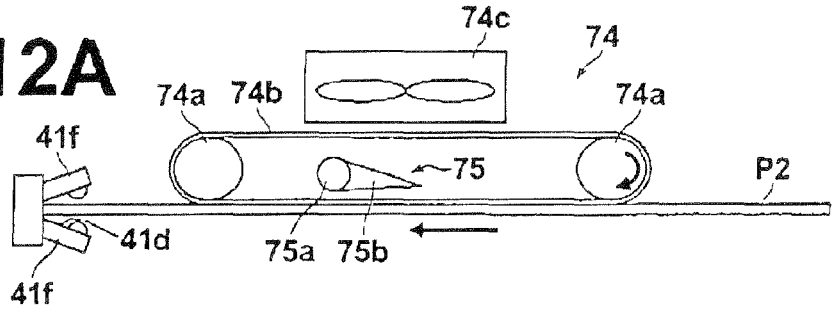
FIGS. 12A, 12B, 12C, and 12D are diagrams for explaining the steps from loading sheets into and ejecting the sheets from a storage section of a duplex screen printing apparatus according to a fourth embodiment of the present invention.

As illustrated in FIG. 12A, a sheet P2 is suctioned and conveyed by the loading device 74 to the sheet insert position C1, at which the center of the bottom edge of the sheet P2 is inserted into the recess 41*d*. Then, movement of the recess 41*d* toward the sheet discharge position C2 is initiated by movement of the conveyor belt 41*b* of FIG. 5. Accompanying the movement of the recess 41*d*, the clamping section 41*f* initiates a closing operation.

Figure 12B:
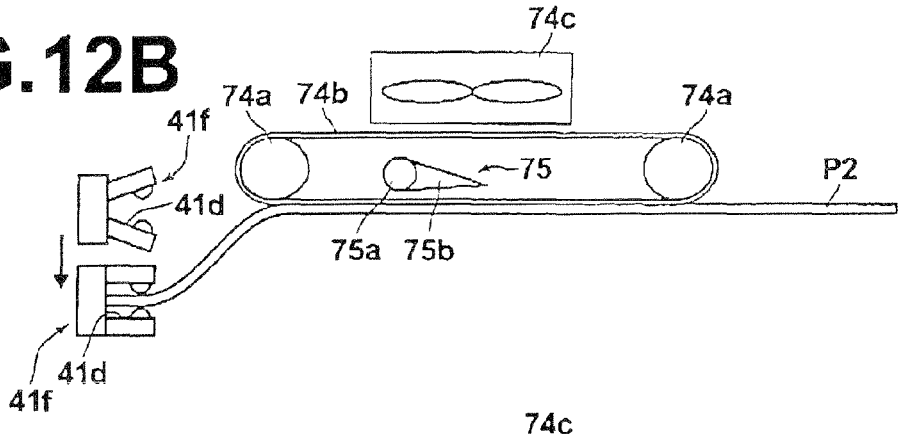
Figure 12C:
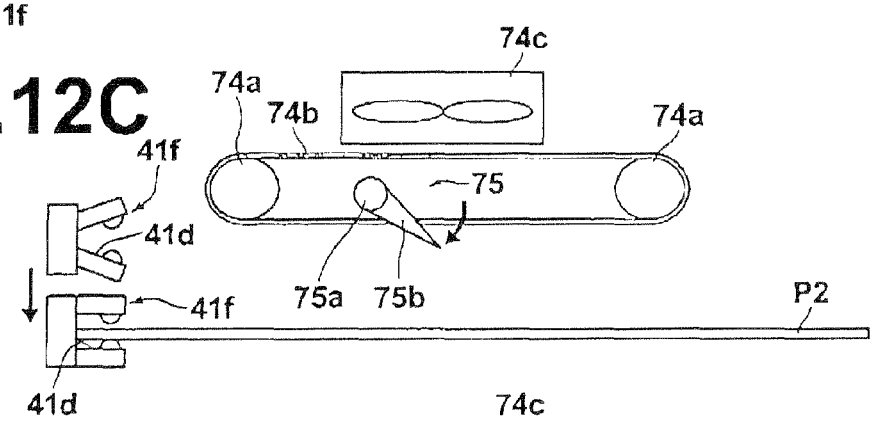

When the conveyor belt 41*b* moves for the space of a single recess 41*d* and the clamping section 41*f* is in a closed state and is clamping the sheet P2 as illustrated in FIG. 12B, the conveyor belt 74*b* of the loading device 74 is stopped substantially simultaneously with the clamping of the sheet P2. At this time, the rotating shaft 75*a* is rotated, and the sheet P2 is separated from the conveyor belt 74*b* by the separating claw 75*b*, as illustrated in FIG. 12C.

Figure 12D:
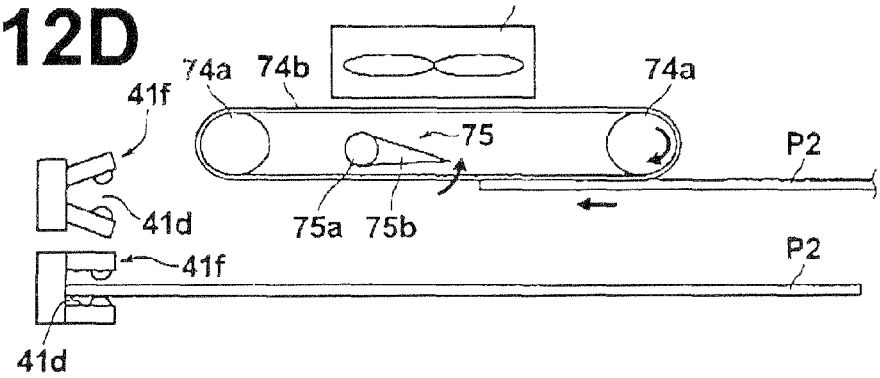

As soon as the sheet P2 is separated from the conveyor belt 74*b*, the rotating shaft 75*a* is rotated in the reverse direction to move the separating claw 75*b* to a position where it will not impede loading of sheets, as illustrated in FIG. 12D. The loading device 74 loads a next sheet P2 into a next recess 41*d*, and the operations illustrated in FIGS. 12A through 12D are repeated.

By performing the separating operation as described above, the sheets P2 can be positively separated from the conveyor belt 74*b*. Therefore, positional shifting of a subsequent sheet P2 caused by contact with a previous sheet P2 when the subsequent sheet P2 is loaded by the loading device 74 can be prevented. In addition, rubbing of the first sides A of subsequent sheets P2 by previous sheets P2 can also be prevented. Thereby, loading of the sheets P2 by the loading device 74 can be performed positively and stably.

In addition, the separating operation is performed in a state in which the centers of the bottom edges of the sheets P2 are clamped by the clamping sections 41*f*. Therefore, positional shifting of the sheets P2 can be suppressed, even if the sheets P2 are separated from the conveyor belt 74*b* at great force. Note that when the clamping section 41*f* moves for the space of one recess 41*d* and clamps the center of the bottom edge of a sheet P2, the fan 74*c* of the loading device 74 is rotating, and the sheet P2 is being suctioned onto the conveyor belt 74*b*. Therefore, the sheet P2 becomes curved such that the center of the bottom edge which is clamped by the clamping section 41*f* is more downstream in the conveyance direction than the central portion of the sheet P2, which is being suctioned onto the conveyor belt 74*b*. However, because the pitches among the clamping sections 41*f* are small, the curve is slight, and there is little possibility that problematic positional shifting will be caused thereby.

Note that embodiments of the duplex printing apparatus of the present invention have been described. However, the duplex printing apparatus of the present invention is not limited to the duplex screen printing apparatuses of the embodiments. For example, a scanner section for reading images of originals and/or a stencil producing section for forming apertures in screen printing stencil sheets based on screen printing image data generated based on the image data of the originals read out by the scanner section may be provided above the housing 10.

The duplex printing apparatus is not limited to the embodiments described above. Various changes and modifications are possible, as long as they do not stray from the spirit and scope of the invention.

What is claimed is:

1. A duplex printing apparatus, comprising:

first printing means for printing on first sides of sheets;

a storage section for storing a plurality of the sheets, the first sides of which have been printed on;

second printing means for printing on second sides of the sheets;

first conveying means for sequentially conveying the sheets, the first sides of which have been printed on, to the storage section; and second conveying means for sequentially conveying the plurality of sheets which are stored at the storage section to the second printing means;

the storage section being equipped with a holding mechanism that holds the plurality of sheets, the first sides of which have been printed on, in an overlapped state with predetermined intervals therebetween;

wherein:

the holding mechanism is equipped with a bottom edge supporting means, for supporting the bottom edges of each of the plurality of sheets with predetermined intervals therebetween such that they are held in an upright state, and curl imparting means, for imparting curls to the sheets such that they are curled with the first sides thereof having a concave shape in horizontal cross sections;

the storage section has a sheet insert position, at which the sheets which are conveyed by the first conveying means enter the storage section, and a sheet discharge position, at which the stored sheets are passed on to the second conveying means; the sheet insert position and the sheet discharge position are spaced a predetermined distance apart from each other; and the holding mechanism sequentially holds each of the sheets that enter the storage section from the sheet insert position, and moves each of the sheets toward the sheet discharge position, while the sheets are in an overlapped state with predetermined intervals therebetween.

2. A duplex printing apparatus as defined in claim 1, wherein:

the bottom edge supporting means sequentially supports the bottom edge of each of the sheets that enter the storage section from the sheet insert position, and moves each of the sheets toward the sheet discharge position, while the sheets are in an overlapped state with predetermined intervals therebetween.

3. A duplex printing apparatus as defined in claim 2, wherein:

the bottom edge supporting means supports the bottom edges of the sheets and moves the sheets in the direction that the first sides face toward.

4. A duplex printing apparatus as defined in claim 2, wherein:

the bottom edge supporting means is equipped with recesses which are arranged with predetermined intervals therebetween in the direction that the sheets are moved in;

the bottom edges of the sheets are supported by the recesses; and the sheets are moved by moving the recesses in the direction that the sheets are moved in.

5. A duplex printing apparatus as defined in claim 2, wherein:

the bottom edge supporting means is a threaded shaft that extends in the direction that the sheets are moved in;

the threads of the threaded shaft support the bottom edges of the sheets; and the sheets are moved by rotating the threaded shaft.

6. A duplex printing apparatus as defined in claim 2, wherein:

the bottom edge supporting means is equipped with clamps which are capable of being opened and closed, arranged with predetermined intervals therebetween in the direction that the sheets are moved in;

the clamps grip the bottom edges of the sheets; and the sheets are moved by moving the clamps in the direction that the sheets are moved in.

7. A duplex printing apparatus as defined in claim 2, wherein:

the bottom edge supporting means is equipped with an annular conveyor belt and a clamp portion that is equipped with a plurality of plates which are directed with predetermined intervals therebetween on the entirety of the outer peripheral surface of the conveyor belt; and each of the plurality of plates is equipped with an elastically deformable claw piece that extends toward an adjacent plate which is upstream in the conveyance direction of the conveyor belt from the elastically deformable claw piece.

8. A duplex printing apparatus as defined in claim 1, wherein:

the curl imparting means is a guide member that presses the left and right side portions of the sheets which are conveyed into the sheet insert position toward the direction that the first sides face than the central portions of the sheets, such that the sheets are curled with the first sides thereof having a concave shape in horizontal cross sections.

9. A duplex printing apparatus as defined in claim 8, wherein:

the guide member is configured such that the position thereof along the direction that the sheets are moved in is adjustable.

10. A duplex printing apparatus as defined in claim 1, wherein:

the amount of time that the sheets are stored for between the time that the sheets are conveyed into the storage section and the time that the sheets are conveyed out of the storage section is controlled based on the printing percentage onto the first sides of the sheets.

11. A duplex printing apparatus as defined in claim 10, wherein:

the control means controls the speed at which the sheets are conveyed from the sheet insert position to the sheet discharge position.

12. A duplex printing apparatus as defined in claim 1, wherein:

at least one of the first conveying means and the second conveying means is equipped with a suctioning section for conveying the sheets into or out of the storage section while suctioning the sheets; and the duplex printing apparatus further comprises a separating means, for separating the sheets which are suctioned onto the at least one suctioning section.

13. A duplex printing apparatus as defined in claim 12, wherein:

the holding mechanism is equipped with a bottom edge supporting means, for supporting the bottom edges of each of the plurality of sheets with predetermined intervals therebetween such that they are held in an upright state;

the bottom edge supporting means moves the sheets in an intermittent manner.

14. A duplex printing apparatus, comprising:

first printing means for printing on first sides of sheets;

a storage section for storing a plurality of the sheets, the first sides of which have been printed on;

second printing means for printing on second sides of the sheets;

first conveying means for sequentially conveying the sheets, the first sides of which have been printed on, to the storage section; and second conveying means for sequentially conveying the plurality of sheets which are stored at the storage section to the second printing means;

the storage section being equipped with a holding mechanism that holds the plurality of sheets, the first sides of which have been printed on, in an overlapped state with predetermined intervals therebetween, wherein:

at least one of the first conveying means and the second conveying means is equipped with a suctioning section for conveying the sheets into or out of the storage section while suctioning the sheets; and the duplex printing apparatus further comprises a separating means, for separating the sheets which are suctioned onto the at least one suctioning section; and the holding mechanism is equipped with a bottom edge supporting means, for supporting the bottom edges of each of the plurality of sheets with predetermined intervals therebetween such that they are held in an upright state;

the bottom edge supporting means moves the sheets in an intermittent manner.

15. A duplex printing apparatus as defined in claim 14, wherein:

the holding mechanism supports the bottom edges of each of the plurality of sheets with predetermined intervals therebetween such that they are held in an upright state, and such that the sheets are curled with the first sides thereof having a concave shape in horizontal cross sections.

16. A duplex printing apparatus as defined in claim 15, wherein:

the holding mechanism is equipped with a bottom edge supporting means, for supporting the bottom edges of each of the plurality of sheets with predetermined intervals therebetween such that they are held in an upright state, and curl imparting means, for imparting curls to the sheets such that they are curled with the first sides thereof having a concave shape in horizontal cross sections.

17. A duplex printing apparatus as defined in claim 14, wherein:

the storage section has a sheet insert position, at which the sheets which are conveyed by the first conveying means enter the storage section, and a sheet discharge position, at which the stored sheets are passed on to the second conveying means; the sheet insert position and the sheet discharge position are spaced a predetermined distance apart from each other; and the bottom edge supporting means sequentially supports the bottom edge of each of the sheets that enter the storage section from the sheet insert position, and moves each of the sheets toward the sheet discharge position, while the sheets are in an overlapped state with predetermined intervals therebetween.

18. A duplex printing apparatus as defined in claim 17, wherein:

the bottom edge supporting means supports the bottom edges of the sheets and moves the sheets in the direction that the first sides face toward.

19. A duplex printing apparatus as defined in claim 14, wherein:

the holding mechanism is equipped with curl imparting means for imparting curls to the sheets, and the curl imparting means is a guide member that presses the left and right side portions of the sheets which are conveyed into the sheet insert position toward the direction that the first sides face than the central portions of the sheets, such that the sheets are curled with the first sides thereof having a concave shape in horizontal cross sections.

20. A duplex printing apparatus as defined in claim 19, wherein:

the guide member is configured such that the position thereof along the direction that the sheets are moved in is adjustable.

21. A duplex printing apparatus as defined in claim 14, wherein:

the amount of time that the sheets are stored for between the time that the sheets are conveyed into the storage section and the time that the sheets are conveyed out of the storage section is controlled based on the printing percentage onto the first sides of the sheets.

22. A duplex printing apparatus as defined in claim 21, wherein:

the speed at which the sheets are conveyed from the sheet insert position to the sheet discharge position is controlled.

* * * * *